United States Patent [19]

McGourty et al.

[11] Patent Number: 4,754,625

[45] Date of Patent: Jul. 5, 1988

[54] ELECTRICALLY CONTROLLED LOCK

[76] Inventors: Thomas K. McGourty, 9570 Chimney Rock Rd.; Lawrence F. McGourty, 6680 Linne Rd., both of Paso Robles, Calif. 93446

[21] Appl. No.: 26,307

[22] Filed: Mar. 16, 1987

[51] Int. Cl.[4] ..... E05B 49/00

[52] U.S. Cl. ..... 70/214; 70/277; 70/278

[58] Field of Search ..... 70/213, 214, 278, 277, 70/279–283; 292/359, 336.3

[56] References Cited

U.S. PATENT DOCUMENTS

| | | | |
|---|---|---|---|
| 3,894,417 | 7/1975 | Taniyama | 70/156 |
| 3,939,315 | 2/1976 | Schlage | 200/61.64 |
| 3,967,846 | 7/1976 | Schlage | 292/359 |
| 4,148,092 | 4/1979 | Martin | 70/278 |
| 4,457,148 | 7/1984 | Johansson | 70/278 |
| 4,603,564 | 8/1986 | Kleinhanj | 70/277 |
| 4,633,687 | 1/1987 | Fane | 70/278 |
| 4,640,110 | 2/1987 | Fish | 70/214 |
| 4,641,868 | 2/1987 | Mirom | 292/359 |

*Primary Examiner*—Robert L. Wolfe

*Attorney, Agent, or Firm*—Fred N. Schwend

[57] ABSTRACT

The knob spindle of a door lock is locked by a locking element supported for movement about an axis parallel to the spindle axis, and a latch, also supported for movement about an axis parallel to the spindle axis, latches the locking element in both locking and unlocking positions. Spring means urge the latch into latching position. Electromagnets are energized sequentially to move the latch into unlatching position and the locking element into unlocking position.

11 Claims, 3 Drawing Sheets

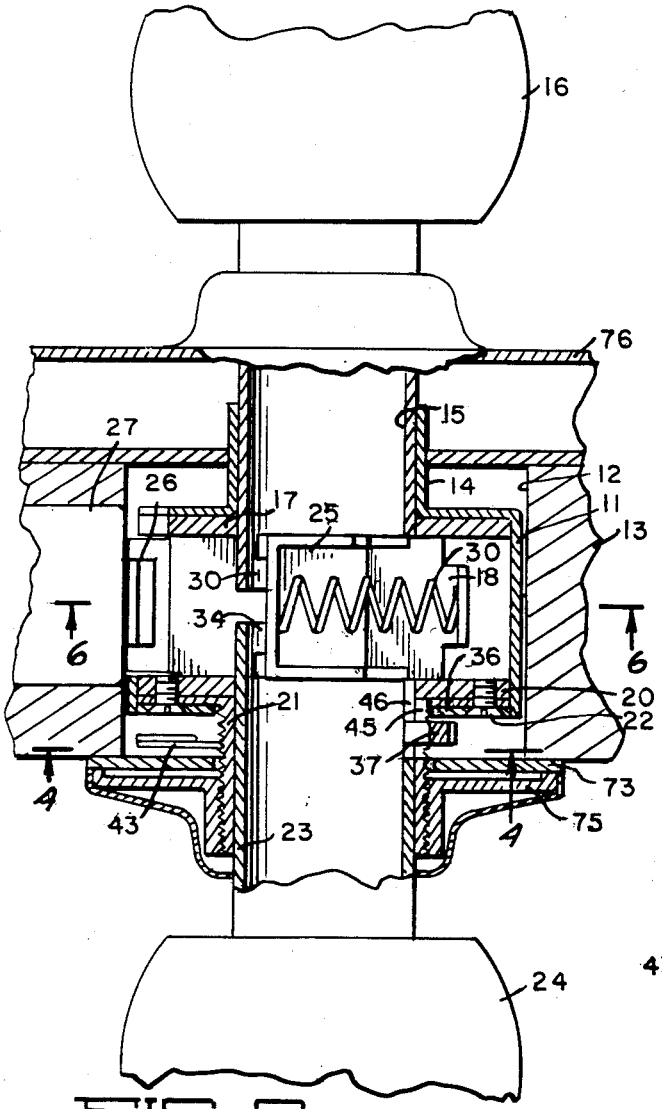
FIG. 3.
FIG. 5.
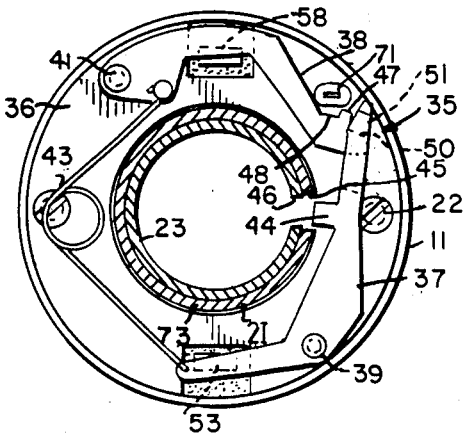
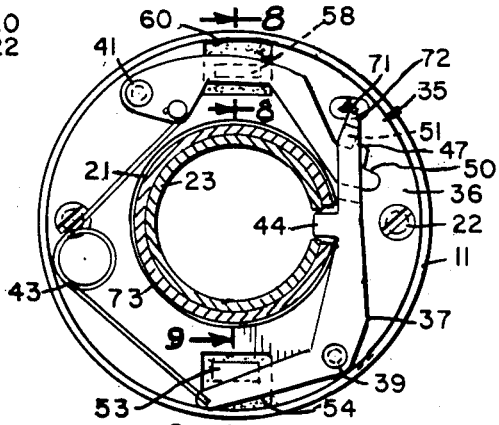
FIG. 4.

ELECTRICALLY CONTROLLED LOCK

BACKGROUND OF THE INVENTION

1. Field of the Invention

This invention relates to locks and has particular reference to electrically controlled door locks such as those controlled from a remote point or those controlled by a magnetic card or a push button combination in which buttons must be pressed in a predetermined order to effect release of the lock.

2. Description of the Prior Art

Door locks, particularly of the key controlled type, are generally of a standard size and fit in a standard size opening in a door. Thus, they are usually interchangeable.

On the other hand, electrically controlled locks are of particular advantage in high security situations, hotels, etc. where keys used to open the usual key locks may be readily copied, or the locks may be readily picked, to enable unauthorized access to otherwise secured locations. However, electrically controlled locks, either of the remotely controlled type or the push button combination type, are generally quite bulky and of a larger size requiring special door lock openings, so thus they are not easily interchangeable with key locks. Furthermore, electrically controlled locks generally require relatively large electric power supplies, thus rendering it impractical to provide a self contained lock unit with batteries incorporated therein but require, instead, electrical power from an external source.

SUMMARY OF THE INVENTION

Accordingly, a principal object of the present invention is to provide an electrically controlled lock unit which is self contained.

Another object is to provide an electrically controlled lock unit which uses a minimum amount of electric current so that miniature batteries can be used as a power supply.

Another object is to provide an electrically controlled lock unit which will fit within a standard size key lock door opening.

A further object is to provide an electric lock control device which can be incorporated in a standard commercially available lock mechanism without substantial modification.

A further object is to provide an electronically controlled lock which will withstand violent slamming, jarring or vibration of a door to which it is attached without misfunctioning.

A further object is to provide an electrically controlled lock with means for indicating the condition of the lock.

A still further object is to provide an electrically controlled lock unit which requires only electrical pulses for operation.

BRIEF DESCRIPTION OF THE DRAWINGS

According to the invention, an electric door lock control mechanism is provided comprising an electromagnetically released locking element for normally locking a knob spindle against rotation and an electromagnetically released latching element is provided for positively latching the locking element in both a locking condition and an unlocking condition.

According to one aspect of the invention, the lock control mechanism is attached to a standard door lock.

Figure 1:
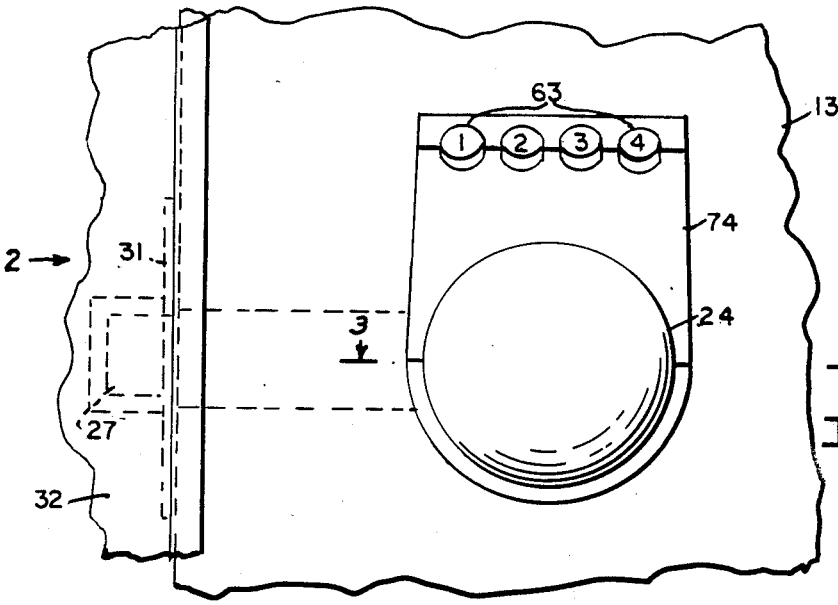

The manner in which the above and other objects are accomplished will be readily understood on reference to the following specification when read in conjunction with the accompanying drawings, wherein:

FIG. 1 is a view from the exterior side of a door, embodying a preferred form of the present invention.

Figure 2:
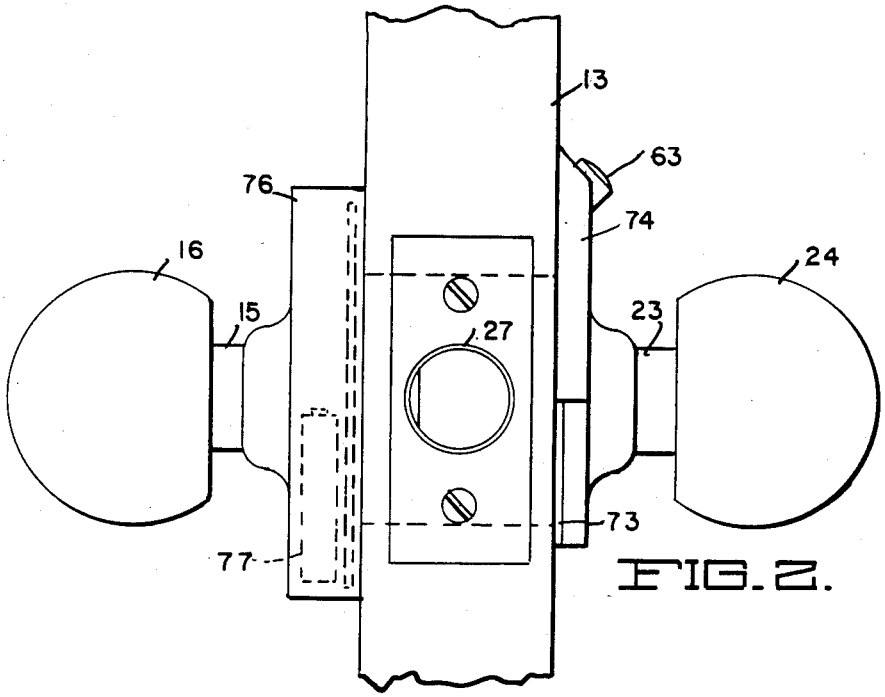

FIG. 2 is an edge view of the door and lock unit and is taken in the direction of the arrow 2 in FIG. 1.

FIG. 3 is a sectional plan view taken along line 3—3 of FIG. 1.

FIG. 4 is a transverse sectional view of the lock unit and locking attachment, showing the same in locked condition and is taken along the line 4—4 of FIG. 3.

FIG. 5 is a transverse sectional view similar to FIG. 4 but showing the locking attachment in unlocked condition.

Figure 6:
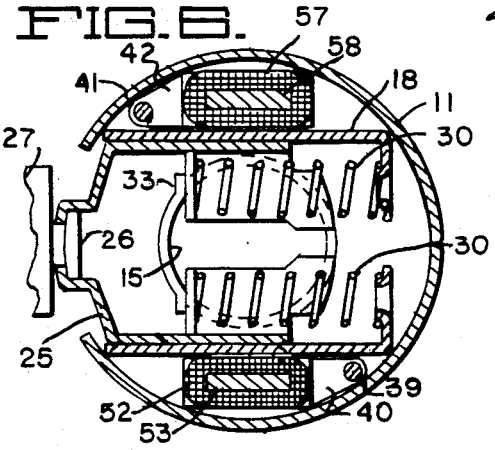

FIG. 6 is a transverse sectional view taken along line 6—6 of FIG. 3.

Figure 7:
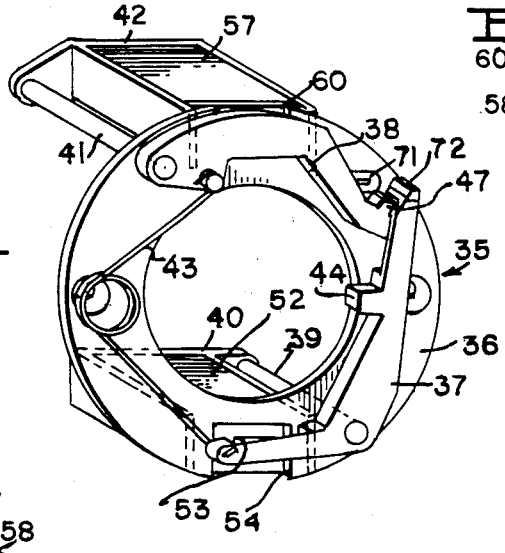

FIG. 7 is a perspective view of the electric locking attachment.

Figure 8:
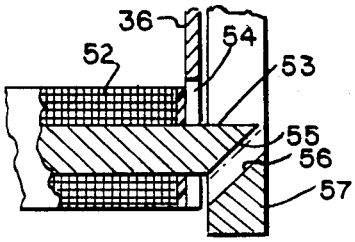

FIG. 8 is an enlarged fragmentary sectional view taken along the line 8—8 of FIG. 4.

Figure 9:
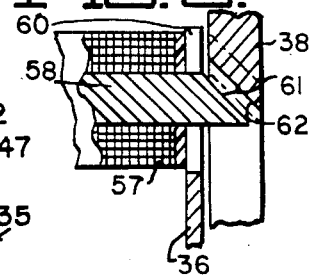

FIG. 9 is an enlarged fragmentary sectional view taken along the line 9—9 of FIG. 4.

Figure 10:
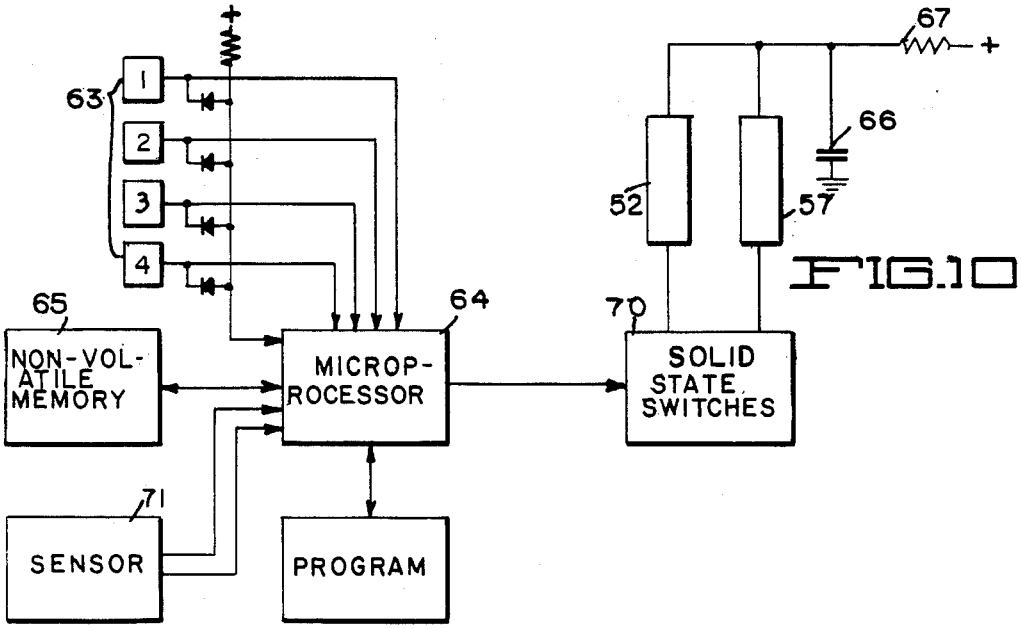

FIG. 10 is a schematic view of the electric circuit for controlling the locking attachment.

DESCRIPTION OF THE PREFERRED EMBODIMENT

While this invention is susceptible to embodiment in many different forms, there is shown in the drawings, and will be described, a certain embodiment, with the understanding that the present disclosure is to be considered as an exemplification of the principles of the invention and is not intended to limit the invention to the embodiment illustrated. The scope of the invention, will be pointed out in the appended claims.

Referring to the drawings, parts of the basic lock mechanism disclosed therein are found in a commercially available door lock manufactured by Schlage Lock Co. and basically disclosed, for example, in U.S. Pat. No. 2,834,194 issued on May 13, 1958. However basic door lock mechanisms manufactured by other firms could also be used.

Such basic lock mechanism comprises a cylindrical lock frame or body 11 (FIGS. 3 to 6) arranged to fit within a standard size lock bore 12 in a door 13. The frame 11 is reduced in diameter at 14 at one end to form a bearing for a hollow interior knob spindle 15 to which an interior knob 16 is suitably attached, the knob being located on the interior side of the door. An annular wall 17 is suitably secured to the frame 11 at one end thereof and forms a part thereof along with a cross member 18.

A second annular wall member 20 is suitably attached to the opposite end of cross member 18 and has a flanged hub 21 secured thereto by screws 22. The hub 21 forms a bearing for rotatably supporting a hollow exterior knob spindle 23 for rotation about an axis coincident with the axis of spindle 15. An exterior knob 24 is suitably attached to the spindle 23.

A retractor or roll back slide 25 is slidably supported by the cross member 18 and is connected at 26 to a latch bolt 27 (see also FIG. 1). Compression springs 30 interposed between parts of the cross member 18 and parts of the slide 25 cause the latter to normally hold the latch bolt 27 in locked condition wherein it engages with a strike plate 31 suitably secured to a door frame 32 to lock the door 13 in closed condition. Camming ears 33 on the interior knob spindle 15 are effective on rotation of the spindle in either direction to retract the slide 25 against the action of springs 30 to withdraw the latch bolt 27. Similarly, camming ears 34 on the exterior knob spindle 23 are effective on rotation of the spindle in either direction to withdraw the bolt 27.

In accordance with the present invention, an electrically controlled locking mechanism, generally indicated at 35 (FIGS. 5 to 7), is provided to normally lock the exterior knob spindle 23 from notation while allowing free rotation of the interior knob spindle 15.

The mechanism 35 comprises an annular mounting plate 36 secured to the flanged side of the bearing hub 21 by the aforementioned screws 22. A locking element 37 is secured to a pin 39 pivotally mounted in spaced bearings formed in the plate 36 and in a rectangular magnet frame 40 (FIG. 7) suitably attached to the side of plate 36 to permit rocking of the element 37 about an axis parallel to the coincident axis of spindles 15 and 23. A latching element 38 is carried by a pin 41 mounted in bearings formed in the plate 36 and in a second rectangular magnet frame 42 suitably attached to the side of plate 36 to likewise permit rocking of the element 38 about an axis parallel to the axes of spindles 15 and 23.

A light hairspring 43 is tensioned between the elements 37 and 38 to urge both elements counterclockwise toward their relative positions shown in FIG. 4 wherein a locking nose 44 on element 37 passes through an enlarged slot 45 in the hub 21 and fits in a locking slot 46 in the spindle 23 to lock the spindle against rotation.

The latching element 38 has a latching tip 47 located between spaced shoulders 48 and 50. In the normally locked condition of FIG. 4, the tip 47 lies against a laterally extending tip 51 on the element 37 and thus prevents the latter from being dislodged from its locking condition due to vibration, or other jarring effects.

An elongated electromagnet coil 52 (FIGS. 6 to 9) is mounted in the magnet frame 40 on a magnet core piece 53 which extends through an opening 54 in the mounting plate 36 and terminates in an angled pole face 55. The latter extends parallel to a cooperating angled pole face 56 formed on the element 37. Thus, upon energizing coil 52, the magnetic flux generated across pole faces 55 and 56 will tend to rock the element 37 toward its unlocking position, shown in FIG. 5.

The arrangement of the coil 52 with its length extending parallel to the axes of the knob spindles 15 and 23 permits the same to be placed in the space between the cross member 18 and the interior of the lock frame 11, as shown in FIG. 6, without taking up space outside the body frame. This arrangement also enables the above noted parallel, angled pole faces 55 and 56 which results in a highly efficient magnetic interaction enabling a small magnetic force developed by the coil 52 to rock the lever 37 against the action of spring 43.

A second electromagnetic coil 57 is mounted in the magnet frame 42 on a magnet core piece 58 which extends through an opening 60 in the mounting plate 36 and also terminates in an angled pole face 61 which extends parallel to an angled pole face 62 formed on the latching element 38. Thus, upon energizing the coil 57, the same action will occur as mentioned in connection with coil 52 to rock the element 38 clockwise against the action of spring 43 to release the locking element 37. Coil 57 also fits in the space between the cross member 18 and the interior of the lock frame 11.

In order to effect movement of the locking element 37 from its locking position of FIG. 4 to its unlocking position of FIG. 5 with a minimum amount of energizing current applied to the coils 52 and 57, the spring 43 is made relatively weak and the coil 57 is only momentarily energized, or pulsed, removing its latching tip 47 from the tip 51 of the element 37. Shortly thereafter, the coil 52 is momentarily energized to rock the element 37 clockwise to its unlocking position of FIG. 5 without any frictional engagement with the latching element 38. The length of the pulse applied to coil 57 is such that as the element 37 reaches its unlocking position the spring 43 becomes effective to rock the latching element counterclockwise, enabling the latching shoulder 47 to fall behind the tip 51 of element 37 and thus positively latch the element 37 against return to locking position by spring 43.

To effect return of the locking element 37 to its locking position of FIG. 4, the coil 57 is pulsed to release the latching element 38, allowing the locking element 37 to return to its locking position where it is retained by engagement of the tip 47 with the side of latching shoulder 51 as depicted in FIG. 4. Thereafter, spring 43 holds the latching element 38 in latching position to prevent possible dislodging of the locking element 37 from its locking position due to slamming of the door or other jarring forces.

The pivoted arrangement of the locking element 37 with its pivot axis parallel to the axis of the knob spindle 23 directs the force of any attempted rotation of the knob spindle to be applied directly against the pivot pin 39. Thus, the locking element may be made relatively light and small in size and yet be fully effective to resist any forced rotation of the knob spindle. Also, the pivoted arrangement of the locking element, as well as the latching element 38, reduces any sliding friction to a minimum and thus reduces the spring and electromagnetic forces required to move them to a minimum.

The present embodiment is disclosed as being incorporated with a combination push button system for effecting energization of the electromagnetic coils 52 and 57 in proper sequence to effect locking and unlocking functions.

Referring to the schematic electrical diagram of FIG. 10, four push button switches 63 are provided which must be pressed in proper sequence. Upon closing of a first switch 63, a microprocessor 64 will be activated to scan all switches that are being closed and to compare the code thus set up with a code stored in a memory 65. When a comparison is reached, a solid state switch circuitry 70 is actuated to energize the coils 52 and 27 in the aforementioned sequence. In order to reduce the drain on the power supply to a minimum, a capacitor 66 is connected in the circuit of the coils 52 and 57. The capacitor is charged through a current limiting resistor 67. Thus, the capacitor is quickly discharged through the coils to provide a momentary high current surge without a sever drain on the power supply.

Means are provided to determine the locked or unlocked condition of the lock unit and to control the microprocessor 64 to accordingly perform certain desired functions. For this purpose, a magentic sensor 71 is connected in circuit with the microprocessor and is suitably attached to the mounting plate 36, as seen in FIGS. 4, 5 and 7. Such sensor is preferably of the well known Hall effect type and is located in the path of a permanent magnet tip 72 mounted on the locking element 37. Thus, when the locking element 37 has been moved to unlocking position the sensor 71 will transmit a signal to the microprocessor.

After a predetermined time period following the unlocking operation, the microprocessor will activate the switch circuitry 70 to sequentially energize the electromagnet 57, permitting the spring 43 to return the locking element 37 to locking position and the latch 38 to latching position.

From the foregoing, it will be seen that the locking attachment 35 may be attached to or incorporated in a standard commercially available door lock with only minor modification of the latter and with no modification of the door to which the lock is attached. Also, mainly because of the pivoted interacting locking and latching elements, with their respective electromagnetic actuating dveices, a minimum amount of electrical power is required for operation of the lock, thus enabling use of miniature batteries, such as the 1.5 volt type AA size.

Referring to FIGS. 1, 2 and 3, the push button switches 63 are accessible on the exterior side of the door 13 and are carried in a compartment 74. The lower end of the compartment 74 is formed into a plate 73 which is clamped against the side of the door 13 by an annular escutchen plate 75 which is screw threaded onto the aforementioned flanged hub 21.

A second compartment 76 is suitably clamped against the interior side of the door 13 and contains elements of the circuitry of FIG. 10, including the aforementioned miniature batteries, one of which is shown at 77.

Thus, it will be seen that the entire lock is self contained and that the electric control mechanism can be attached to a standard door lock mechanism with a minimum amount of modification.

Also, it will be noted that the electric control mechanism could, with certain modification, be controlled by other forms of coded input devices, such as a magnetic card reader or the like and could be controlled by remote control devices through suitable signals, such as wireless, ultrasonic, or infra-red signals.

I claim:

1. An electrically controlled lock
comprising
a lock frame;
means including a knob spindle rotatably supported by said frame;
means for preventing said spindle from rotating including a locking element movable from a spindle unlocking position to a spindle locking position;
spring means urging said locking element into said locking position;
first electromagnetic means for moving said locking element into said unlocking position;
a latch;
spring means urging said latch to a latching position to latch said locking element in said unlocking position; and
second electromagnetic means for moving said latch from said latching position.

2. An electrically controlled lock as defined in claim 1 comprising means on said latch for latching said locking element in said locking position.

3. An electrically controlled lock as defined in claim 1 comprising means for energizing said first and second electromagnetic means in sequence.

4. An electrically controlled lock as defined in claim 1 comprising means for sensing at least one of said positions of said locking element and for controlling said first and second electromagnetic means.

5. An electrically controlled lock as defined in claim 3 comprising means for sensing at least one of said positions of said locking element and for controlling said energizing means.

6. An electrically controlled lock as defined in claim 1 comprising means on said frame pivotally supporting said locking element for movement about an axis parallel to the axis of rotation of said spindle.

7. An electronically controlled lock as defined in claim 6 comprising means on said frame pivotally supporting said latch for movement about an axis parallel to said spindle axis.

8. An electrically controlled lock as defined in claim 6 wherein, said first electromagnetic means comprises an elongate electromagnet extending parallel to said spindle axis;
said electromagnet having a pole piece positioned to move said locking element to said locking position upon energization of said electromagnet.

9. An electrically controlled lock as defined in claim 7 wherein said second electromagnetic means comprises a second elongate electromagnet extending parallel to said spindle axis;
said second electromagnet having a second pole piece positioned to move said latch from said latching position.

10. In an electrically controlled lock having a lock frame, and means including a knob spindle rotatably supported by said frame; means for controlling rotation of said spindle
comprising
an annular base member for attachment to said frame with the axis of said plate extending coaxial with the axis of rotation of said spindle;
said member surrounding said spindle;
a locking element;
means on said base member pivotally supporting said locking element for movement about an axis parallel to said plate axis between a spindle unlocking position and a spindle locking position;
spring means urging said locking element into said locking position;
first electromagnetic means supported by said base member for moving said locking element to said unlocking position;
a latch;
means on said base member pivotally supporting said latch for movement about an axis parallel to said plate axis between a latching position latching said locking element in said unlocking position and an unlatching position;
spring means urging said latch to said latching position; and
second electromagnetic means supported by said base member for moving said latch to said unlatching position.

11. Spindle controlling means as defined in claim 1 comprising means on said latch for latching said locking element in both said locking position and said unlocking position.

* * * * *